US005603824A

United States Patent [19]

Kyan et al.

[11] Patent Number: 5,603,824

[45] Date of Patent: Feb. 18, 1997

[54] HYDROCARBON UPGRADING PROCESS

[75] Inventors: Chwan P. Kyan, Mantua; Paul J. Oswald, Voorhees, both of N.J.

[73] Assignee: Mobil Oil Corporation, Fairfax, Va.

[21] Appl. No.: 285,476

[22] Filed: Aug. 3, 1994

[51] Int. Cl.[6] ..... C10G 23/02

[52] U.S. Cl. ..... 208/208 R; 208/58; 208/80; 208/89; 208/212

[58] Field of Search ..... 208/58, 80, 208 R, 208/212, 89

[56] References Cited

U.S. PATENT DOCUMENTS

| | | | |
|---|---|---|---|
| 3,957,625 | 5/1976 | Orkin | 208/211 |
| 4,235,847 | 11/1980 | Scott | 208/46 |
| 4,283,271 | 8/1981 | Garwood et al. | 208/59 |
| 4,390,413 | 6/1983 | O'Rear et al. | 208/61 |
| 4,396,538 | 8/1983 | Chen et al. | 252/455 Z |
| 4,481,105 | 11/1984 | Chou | 208/146 |
| 4,681,674 | 7/1987 | Graven et al. | 208/59 |
| 4,808,350 | 2/1989 | Robbins et al. | 422/220 |
| 4,937,051 | 6/1990 | Graven et al. | 422/194 |
| 5,246,568 | 9/1993 | Forbus et al. | 208/59 |

FOREIGN PATENT DOCUMENTS

| | | |
|---|---|---|
| 0189648A1 | 8/1986 | European Pat. Off. . |
| 0316656B1 | 8/1991 | European Pat. Off. . |
| 2185753 | 7/1987 | United Kingdom . |

*Primary Examiner*—Helane Myers

*Attorney, Agent, or Firm*—M. D. Keen; P. L. Prater

[57] ABSTRACT

The instant invention discloses a process of upgrading a waxy hydrocarbon feed mixture containing sulfur compounds which boils in the distillate range, in order to reduce sulfur content and 85% point while preserving the high octane of naphtha by-products and maximizing distillate yield. The process employs a single, downflow reactor having at least two catalyst beds and an inter-bed redistributor between the beds. The top bed contains a hydrocracking catalyst, preferably zeolite beta, and the bottom bed contains a dewaxing catalyst, preferably ZSM-5. A desulfurization catalyst may be added to either bed depending on sulfur distribution in the feed. The feed is separated into a lighter, lower boiling stream and a heavier, higher boiling stream. The effluent of the top bed cascades without interbed separation to the inter-bed redistributor, where it is recombined with the lighter stream. The recombined stream then enters the bottom bed for dewaxing. The product comprises a distillate having an increased yield and a naphtha having an increased research octane number, as compared with a feedstock in which the entire stream was hydrocracked.

21 Claims, 2 Drawing Sheets

HYDROCARBON UPGRADING PROCESS

FIELD OF THE INVENTION

This invention relates to a process for the upgrading of hydrocarbon streams. It more particularly relates to a process for upgrading middle distillate boiling range petroleum fractions containing substantial portions of waxes or sulfur impurities. This process further employs an integrated hydroprocessing technique in which hydrocracking, dewaxing and desulfurization all occur in a single, vertical two bed reactor. The distillate is split into heavy and light fractions, the heavy fraction being hydrocracked and partially desulfurized in the top reactor bed. The effluent from the top bed is then combined with the light fraction and is cascaded into the bottom reactor bed, where dewaxing for pour point reduction and possibly, further desulfurization occurs. The yield of the dewaxed distillate product is maximized by this process. The octane number of the naphtha by-product is also increased.

BACKGROUND OF THE INVENTION

Heavy petroleum fractions, such as vacuum gas oil, or even resids such as atmospheric residuum, may be catalytically cracked to lighter and more valuable products. In the United States, catalytically cracked gasoline is especially valuable. In Europe, middle distillates such as diesel are fuels of significant importance. It is conventional to recover the product of catalytic cracking and to fractionate the cracking products into various fractions such as light gases; naphtha, including light and heavy gasoline; distillate fractions such as cycle oil and heavier fuel oil fractions (HFO).

Environmental regulations, particularly in Europe, are expected to become more stringent in the future. The sulfur content and 85% point of distillate fuels, such as diesel, will require reduction. The sulfur content of the diesel fuel products of this invention is not to exceed 500 ppm by weight or 0.05 wt. %. In order to reduce the 85% point, high molecular weight components, especially naphthenes and aromatics must be hydrocracked. The 85% point is the temperature at which 85% of the volume of a feed such as a middle distillate has been removed by distillation. If few long chain molecules are present in the feed, the 85% point will be lower than if many long chain molecules are present. Previous distillate dewaxing technologies do not usually result in large reduction of the 85% point or the sulfur content. Such technologies employ shape-selective catalysts such as ZSM-5 which crack straight-chain paraffins and which act mainly on the front end (low boiling portion) of the feed, so that the higher boiling (back end) components, which also contain most of the sulfur, remain less affected by the treatment. Sulfur reduction of a catalytically dewaxed middle distillate feed requires additional hydrotreating which would, unfortunately degrade the octane number of the naphtha produced during the dewaxing by saturation of the olefins in this naphtha. A conventional hydrocracking process employing metals such as nickel or tungsten on an amorphous support, would not effectively lower the pour point and would reduce product yield by non-selective cracking. Naphtha produced as a by-product from hydrocracking is also low in octane.

U.S. Pat. No. 4,390,413 (O'Rear et al) is directed to the processing of distillate and lube fractions. A intermediate pore catalyst such as ZSM-5 catalyst is used in a form which is substantially free of hydrogenation activity, under specific conditions, to dewax (remove paraffins) from petroleum by forming $C_3$–$C_4$ olefins which may be further processed. Dewaxing, then distillation steps occur in separate reaction zones. A conventional hydrocracking catalyst was used.

European Patent 0189648 discloses catalytic dewaxing with an intermediate pore catalyst such as ZSM-5. The patent is directed to the production of distillates and naphtha by-products. Heavy gas oil feed is hydrowaxed. Distillation occurs following hydrodewaxing, in a separate reaction zone. Certain streams, such as heavy distillates or heavy kerosine, may be catalytically dewaxed following distillation. A conventional hydrocracking catalyst is used, having both an acidic function and a hydrogenation function.

European Patent 0316656 discloses a process for the production of high-quality gas oil from heavy feedstocks, utilizing catalytic dewaxing and desulfurization techniques. The dewaxing and desulfurization occur in different reaction zones. There is opportunity for interstage separation. Each step is optional, depending upon the characteristics of the feed. Dewaxing may be necessary but not desulfurization, or vice-versa.

British Patent Application GB2,185,753A discloses a process for the removal of waxy paraffins from hydrocarbon feedstocks which boil in the gas oil range and contain sulfur. The process comprises passing the feed over a crystalline high silica ZSM-5 variety under suitable operating conditions for the cracking of straight chain paraffins.

SUMMARY OF THE INVENTION

An integrated hydroprocessing technique has now been devised which reduces pour point, 85% point, and sulfur content while maximizing dewaxed oil yield and naphtha octane. The process occurs in a single reactor having two catalyst beds arranged vertically, one atop the other. The distillate feed, which has a large sulfur content, is separated into light and heavy fractions. The cut point separating the two fractions is determined by the extent of desulfurization required by the feed. The heavier fraction is passed through a heater prior to entering the reactor, where it encounters the top catalyst bed. This bed contains a hydrocracking catalyst, preferably zeolite beta. The lighter fraction may be heated or cooled as desired and enters the reactor between the catalyst beds, at the interbed redistributor. The entire volume of distillate then cascades without interstage separation into the second bed, where it encounters a dewaxing catalyst such as ZSM-5. The distillate product has a reduced pour point, a lower sulfur content than the feed, and a reduced 85% point. Because the lighter fraction is not subjected to the hydrocracking reactions of the top bed, a high distillate yield is preserved. Naphtha, produced as a by-product of hydrodewaxing, has an increased octane number, since the lighter fraction does not pass through the hydrocracking zone. The olefins of the naphtha are thus not subjected to undesired saturation. The dewaxing catalyst boosts the octane of the naphtha produced as a by-product in the hydrocracking reaction through shape-selective cracking reactions. Naphtha from the dewaxing reaction is olefin-rich, therefore high in octane.

Although most desulfurization occurs during hydrocracking, additional desulfurization may occur if a desulfurization catalyst is added to the dewaxing catalyst in the lower bed subsequent to the hydrocracking catalyst. Additional desulfurization may be necessary if the sulfur is evenly distributed throughout the boiling range of the distillate feed and is not concentrated in the heavier, higher boiling portion. The cut point between the heavier and lighter fractions is dependent upon the manner in which the sulfur is distributed throughout the feed. It is further dependent on the extent of desulfurization required by the feed before it is pretreated by the hydrocracking catalyst. Desulfurization catalyst may also be added to the top catalyst bed if desired. The feed cut point is generally between 550° and 800° F., preferably between 600° and 750° F. and now preferably between 650°–700° F.

The process of the instant invention possesses numerous advantages over conventional technologies. Hydrocracking, desulfurization, and dewaxing occur simultaneously in a single reactor, thereby eliminating the need for costly multiple reactors and separation between reactors. Furthermore, hydrocracking only the heavy fraction maximizes the distillate yield, since the hydrocracker effluent remains primarily in the distillate boiling range. The light fraction is not unnecessarily cracked to lighter products.

Hydrocracking of the heavy fraction in the first catalyst bed over a large-pore catalyst such as zeolite beta will dewax a portion of the feed, thereby decreasing the dewaxing load in the second bed, in which a shape-selective catalyst such as ZSM-5 is used. Ammonia and $H_2S$ are produced during the hydrocracking process, since the majority of sulfurs and heteroatoms in the waxy distillate feed are in the heavy fraction and inhibit the hydrodewaxing to a certain extent. The benefits of hydrocracking outweigh possible negative effects of these by-products, however.

In the instant invention, a synergy exists between the exothermic hydrocracking reaction of the top bed and the endothermic dewaxing reaction of the second bed, resulting in better control of temperatures in various portions of the reactor. The temperature of the combined stream entering the second bed is further controlled by feeding the lighter distillate fraction into a redistribution zone between the top and bottom beds. Then it combines with the hydrocracker effluent. As FIG. 3 illustrates, the light distillate fraction may be heated or cooled as desired before it enters the redistribution zone.

DETAILED DESCRIPTION OF THE INVENTION

Feedstock

Figure 1:
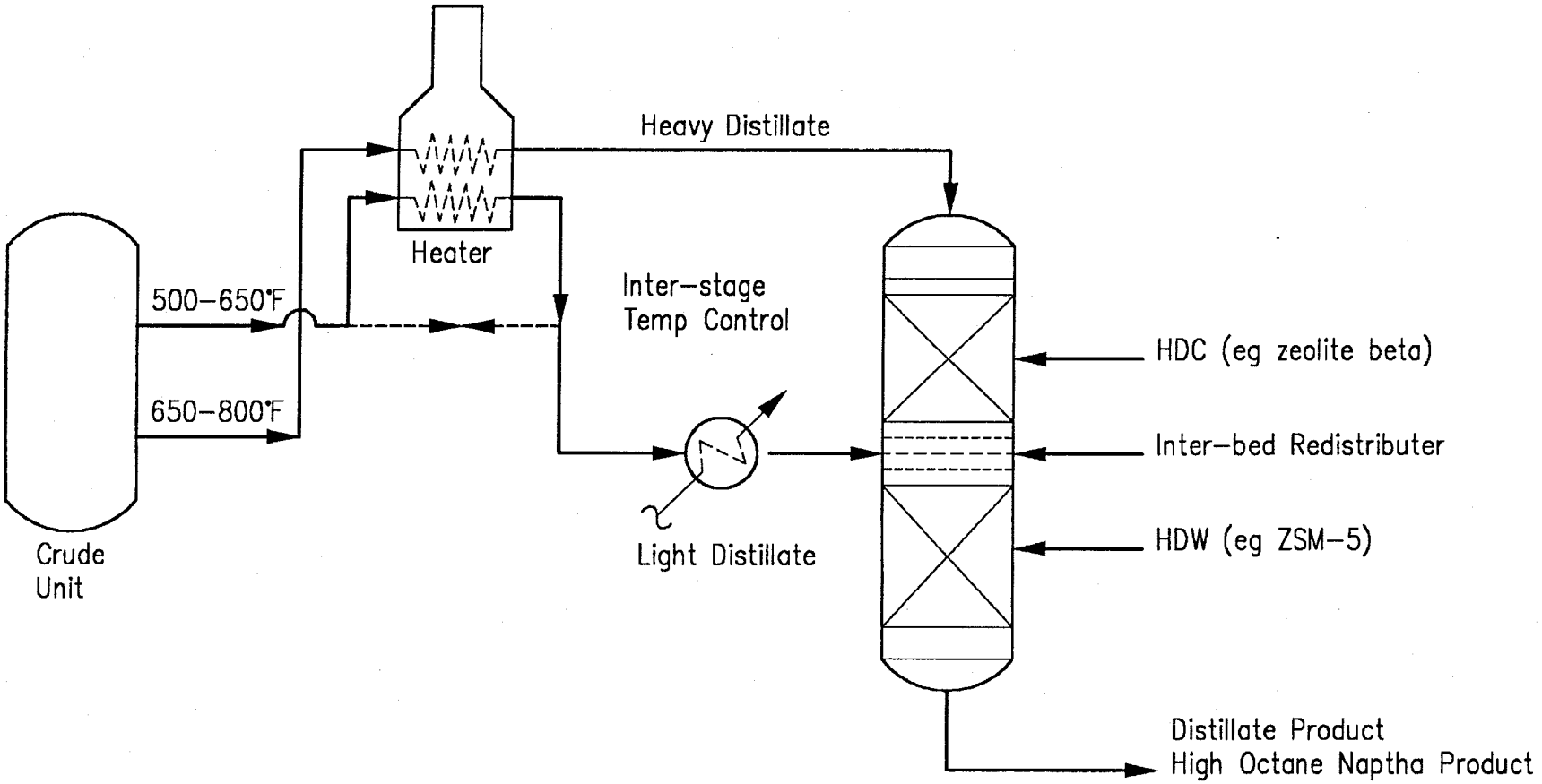
FIG. 1 is a schematic diagram of the process of the instant invention. It illustrates the splitting of the feed into lighter and heavier fractions, and the recombination of these fractions in a single reactor vessel where hydrocracking, dewaxing, and if necessary, desulfurization occur.

The instant process may be used to hydrocrack, to desulfurize and to dewax $C_{10+}$ feedstock. Lighter oils will usually be free of significant quantities of waxy components. The process is particularly useful with waxy, straight-run, distillate stocks, such as gas oils, diesel oil, kerosenes, jet fuels, heating oils and other distillate fractions whose pour point and viscosity need to be maintained within certain specification limits. The feedstock for the instant process will normally be a $C_{1+}$ feedstock containing paraffins, olefins, naphthenes, aromatics and heterocyclic compounds and with a substantial proportion of higher molecular weight n-paraffins and slightly branched paraffins which contribute to the waxy nature of the feedstock. The heavy ends undergo hydrocracking in the top bed of the reactor to form liquid range materials which contribute to a product having a lower pour point as well as a lower sulfur content, nitrogen content and T-85 point. The degree of cracking which occurs is, however, limited so that the gas yield is reduced, thereby preserving the economic value of the feedstock.

Typical feedstocks include light gas oils, heavy gas oils and reduced crudes boiling above 150° C. (300° F.).

Feedstocks containing aromatics, e.g., 10 percent or more aromatics, may be successfully dewaxed. The aromatic content of the feedstock will depend, of course, upon the nature of the crude employed and upon any preceding processing steps, such as hydrocracking, which may have acted to alter the original proportion of aromatics in the oil. The aromatic content will normally not exceed 50% by weight of the feedstock and more usually will be not more than 10–30% by weight, with the remainder consisting of paraffins, olefins, naphthenes and heterocyclics. The paraffin content (normal and iso-paraffins) will generally be at least 10% by weight, more usually at least 20% by weight.

The feedstock, prior to hydrotreating, may typically contain up to 30,000 wt ppm sulfur, and up to 20,000 wt ppm nitrogen, and at least 10% by weight waxy components, like normal paraffins and slightly branched paraffins.

Hydroprocessing Catalysts

A. Hydrocracking Catalysts

Hydrocracking catalysts useful in the instant invention include commercial hydrocracking catalysts, such as nickel-tungsten on USY. Other useful catalysts include NiW on alumina and NiMo on alumina or on a zeolite such as USY. Zeolite beta, however is the preferred hydrocracking catalyst of the instant invention because of its effectiveness in reducing pour point.

Conventional hydrocracking catalysts combine an acidic function and a hydrogenation function. The acidic function in the catalyst is provided by a porous solid carrier such as alumina, silica-alumina, or by a composite of a crystalline zeolite such as faujasite, Zeolite X, Zeolite Y zeolite USY with an amorphous carrier such as alumina. The use of a porous solid with a relatively large pore size in excess of 7Å is generally required because the bulky, polycyclic aromatic compounds which constitute a large portion of the typical feedstock require pore sizes of this magnitude in order to gain access to the internal pore structure of the catalyst where the bulk of the cracking reactions take place.

The hydrogenation function in the hydrocracking catalyst is provided by a transition metal or combination of metals. Noble metals of Group VIIIA of the Periodic Table, especially platinum or palladium may be used, but generally, base metals of Groups IVA, VIA and VIIA are preferred because of their lower cost and relatively greater resistance to the effects of poisoning by contaminants (the Periodic Table used in this specification is the table approved by IUPAC as shown, for example, in the chart of the Fisher Scientific Company, Catalog No. 5-702-10). The preferred base metals for use as hydrogenation components are chromium, molybdenum, tungsten, cobalt and nickel; and, combinations of metals such as nickel-molybdenum, cobalt-molybdenum, cobalt-nickel, nickel-tungsten, cobalt-nickel-molybdenum and nickel-tungsten-titanium have been shown to be very effective and useful. Conventional hydrocracking catalysts tend to favor the production of naphthas rather than middle distillates although low pressure operation (as described in U.S. Pat. No. 4,435,275) can overcome this tendency.

The use of highly siliceous zeolites as the acidic component of the hydrocracking catalyst will also favor the production of distillates at the expense of naphtha, as described in U.S. patent application Ser. No. 744,897 now abandoned, filed Jun. 17, 1985 and its counterpart EU 98,040 to La Pierre et al.

Zeolite Beta is described in U.S. Pat. Nos. 4,913,797 and 4,696,732. The properties of a typical zeolite beta catalyst, loaded with nickel and tungsten, are disclosed in Table 1.

TABLE 1

Properties of Ni—W Zeolite Beta Catalyst (Catalyst contains 50 wt % Zeolite Beta prior to metals addition)

| Physical Properties | |
|---|---|
| Packed Density, | g/cc 0.73 |
| Particle Density, | g/cc 1.15 |
| Surface Area, | 292 |
| Pore Volume, | cc/g 0.558 |
| Pore Diameter, | Angstroms 76 |
| Chemical Compositions, wt % | |
| Nickel | 4.0 |
| Tungsten | 15.5 |

Zeolite beta, in contrast to conventional hydrocracking catalysts, has the ability to attack paraffins in the feed in preference to the aromatics. The effect of this is to reduce the paraffin content of the unconverted fraction in the effluent from the hydrocracker so that it has a relatively low pour point. Conventional hydrocracking catalysts such as the large pore size amorphous materials and crystalline aluminosilicates previously mentioned, are aromatic selective and tend to remove the aromatics from the hydrocracking feed in preference to the paraffins. This results in a net concentration of high molecular weight, waxy paraffins in the unconverted fraction so that the higher boiling fractions from the hydrocracker retain a relatively high pour point (because of the high concentration of waxy paraffins) although the viscosity may be reduced (because of the hydrocracking of the aromatics present in the feed). The high pour point in the unconverted fraction has generally meant that the middle distillates from conventional hydrocracking processes are pour point limited rather than end point limited. The specification for products such as light fuel oil (LFO), jet fuel and diesel fuel generally specify a minimum initial boiling point (IBP) for safety reasons but end point limitations usually arise from the necessity of ensuring adequate product fluidity rather than from any actual need for an end point limitation in itself. In addition, the pour point requirements which are imposed effectively impose an end point limitation of about 345° C. (about 650° F.) with conventional processing techniques because inclusion of higher boiling fractions including significant quantities of paraffins will raise the pour point above the limit set by the specification. When Zeolite Beta is used as the hydrocracking catalyst, the lower pour point of the unconverted fraction enables the end point for the middle distillates to be extended so that the volume of the distillate pool can be increased. Thus, the use of Zeolite Beta as the acidic component of the hydrocracking catalyst effectively increases the yield of the more valuable components by reason of its paraffin selective catalytic properties.

Zeolite Beta is preferably used in combination with a hydrogenation component comprising 0.1–20% by weight on an elemental basis, which is usually derived from a metal of Groups VA, VIA or VIIIA of the Periodic Table. Table 1 illustrates this. Table 2 illustrates the constraint index of zeolite beta. Preferred non-noble metals are such as tungsten, vanadium, molybdenum, nickel, cobalt, chromium, and manganese, and the preferred noble metals are platinum, palladium, iridium and rhodium. The hydrogenation component comprises 0.1–5% by weight on an elemental basis of platinum or palladium, or both, or comprises 0.1–20% by weight on an elemental basis of nickel or tungsten, or both. Combinations of non-noble metals, such as cobalt-molybdenum, cobalt-nickel, nickel-tungsten or cobalt-nickel-tungsten, are useful with many feedstocks and the hydrogenation component is about 0.7 to about 7% by weight of nickel and about 2.1 to about 21% by weight of tungsten, expressed as metal. The hydrogenation component can be exchanged onto the zeolite, impregnated into it or physically admixed with it. If the metal is to be impregnated into or exchanged onto the zeolite, it may be done, for example, by treating the zeolite with platinum metal-containing ion. Suitable platinum compounds include chloroplatinic acid, platinous chloride and various compounds containing the platinum amine complex.

The catalyst may be treated by conventional presulfiding treatments, e.g., by heating in the presence of hydrogen sulfide, to convert oxide forms of the metals, such as CoO or NiO, to their corresponding sulfides.

The metal compounds may be either compounds in which the metal is present in the cation of the compound and compounds in which it is present in the anion of the compound. Both types of compounds can be used. Platinum compounds, in which the metal is in the form of a cation or cationic complex, e.g., $Pt(NH_3)_4Cl_2$, are particularly useful, as are anionic complexes, such as the vanadate and metatungstate ions. Cationic forms of other metals are also very useful because they may be exchanged onto the zeolite or impregnated into it.

It may be desirable to incorporate the catalyst in another material resistant to the temperature and other conditions employed in the process. Such matrix materials include synthetic and naturally occurring substances, such as inorganic materials, e.g., clay, silica and metal oxides. The latter may be either naturally occurring or in the form of gelatinous precipitates or gels, including mixtures or silica and metal oxides. Naturally occurring clays can be composites with the zeolite, including those of the montmorillonite and kaolin families. The clays can be used in the raw state as originally mined or initially subjected to calcination, acid treatment or chemical modification.

The zeolite may be composites with a porous matrix material, such as alumina, silica-alumina, silica-magnesia, silica-zirconia, silica-thoria, silica-berylia, silica-titania, as well as ternary compositions, such as silica-alumina-thoria, silica-alumina-zirconia, magnesia and silica-magnesia-zirconia. The matrix may be in the form of a cogel. The relative proportions of zeolite component and inorganic oxide gel matrix on an anhydrous basis may vary widely with the zeolite content ranging from 10–99% by weight, more usually 25–80% by weight, of the dry composite. The matrix itself may possess catalytic properties, generally of an acidic nature.

Zeolite beta of this invention has an apparent activity (alpha value) of about 5 to 200 under the process conditions to achieve the required degree of reaction severity. The most preferred alpha value is in the vicinity of 50.

The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 (1980).

B. Hydrodesulfurization Catalysts

Catalytic hydrodesulfurization is a well known process. Representative of prior art catalysts used for hydrodesulfurization are those alumina containing catalysts that include as hydrogenation component nickel and molybdenum or cobalt and molybdenum, the hydrogenation components being in the forms of metal or metal compounds. Phosphorus also is often present. Silica may be present in various modifications of such catalysts. An outstanding distinction between hydrocracking and hydrodesulfurization catalysts is that the former includes a strongly acidic component to enhance hydrocarbon cracking, while the latter catalyst is only mildly acidic to limit hydrocarbon cracking. U.S. Pat. No. 3,546,105 to Jaffe is incorporated herein by reference for background purposes.

C. Dewaxing Catalysts

The zeolite catalysts preferred for use in the lower fixed bed of the instant invention include the medium pore (i.e., about 5–7Å) shape-selective crystalline aluminosilicate zeolites having a silica-to-alumina ratio of at least 12, a constraint index of about 1 to 12 and acid cracking activity of about 10–250. Reference is here made to U.S. Pat. No. 4,784,745 for a definition of Constraint Index and a description of how this value is measured. This patent also discloses a substantial number of catalytic materials having the appropriate topology and the pore system structure to be useful in this service. In the fixed bed reactor the catalyst may have an apparent activity (alpha value) of about 50 to 280 under the process conditions to achieve the required degree of reaction severity. The desired alpha values vary with application. See the hydrocracking catalyst section above for discussion on alpha.

ZSM-5 is the most prominent of the intermediate pore, silicious zeolites and is preferred in the instant invention. ZSM-5 is usually synthesized with Bronsted acid active sites by incorporating a tetrahedrally coordinated metal, such as Al, Ga, B or Fe, within the zeolitic framework. ZSM-5 crystalline structure is readily recognized by its X-ray diffraction pattern, which is described in U.S. Pat. No. 3,702,866 (Argauer et al), incorporated by reference.

Other suitable zeolites include ZSM-5, ZSM-11, ZSM-12, ZSM-22, ZSM-23, ZSM-35 and ZSM-38 and are disclosed in U.S. Pat. Nos. 3,709,979; 3,832,449; 4,076,979; 3,832,449; 4,076,842; 4,016,245 and 4,046,839; 4,414,423; 4,417,086; 4,517,396 and 4,542,251. The disclosures of these patents are incorporated herein by reference.

TABLE 2

| | Constraint Index |
|---|---|
| ZSM-4 | 0.5 |
| ZSM-5 | 6–8.3 |
| ZSM-11 | 6–8.7 |
| ZSM-12 | 2 |
| ZSM-20 | 0.5 |
| ZSM-23 | 9.1 |
| ZSM-34 | 30–50 |
| ZSM-35 | 4.5 |
| ZSM-38 | 2 |
| ZSM-48 | 3.5 |
| ZSM-50 | 1–3 |
| TMA Offretite | 3.7 |
| TEA Mordenite | 0.4 |
| Clinoptilolite | 3.4 |
| Modenite | 0.5 |
| REY | 0.4 |
| Amorphous Silica-Alumina | 0.6 |
| Dealuminized Y (Deal Y) | 0.5 |
| Chlorinated Alumina | *1 |
| Erionite | 38 |
| Zeolite Beta | 0.6–1+ |

Preferably these zeolites do not have metal loadings. The medium pore zeolite may contain a hydrogenation/dehydrogenation component, however, which is referred to for convenience as a hydrogenation component. The hydrogenation component is generally a metal or metals of Groups VIIIA of the Periodic Table (IUPAC and U.S. National Bureau of Standards approved Table, as shown, for example, in the Chart of the Fisher Scientific Company, Catalog No. 5-702-10), preferably nickel. The preferred hydrogenation components are the noble metals of Group VIIIA, especially platinum, but other noble metals, such as palladium, gold, silver, rhenium or rhodium, may also be used. Combinations of noble metals, such as platinum-rhenium, platinum-palladium, platinum-iridium or platinum-iridium-rhenium, together with combinations with non-noble metals, particularly of Groups VIA and VIIIA are of interest, particularly with metals such as cobalt, nickel, vanadium, tungsten, titanium and molybdenum, for example, platinum-tungsten, platinum-nickel or platinum-nickel-tungsten. Base metal hydrogenation components may also be used, especially nickel, cobalt, molybdenum, tungsten, copper or zinc. Combinations of base metals, such as cobalt-nickel, cobalt-molybdenum, nickel-tungsten, cobalt-nickel-tungsten or cobalt-nickel-titanium, may also be used. U.S. Pat. No. 4,599,162 hereby incorporated by reference provides further information on the preparation of medium pore zeolites.

Process Configuration and Conditions for the Preferred Embodiment

FIG. 1 discloses the major steps of the preferred embodiment of this invention. A distillate fraction boiling in the range from about 500° F. to about 1000° F., having a substantial wax content, leaves the atmospheric section of a crude distillation unit. It is then subsequently split into light and heavy portions. The temperature range where the separation is made between light and heavy streams is in the range from 500° to 800° F., preferably between 500° and 700° F. The cut point range may vary slightly depending upon the amount of sulfur present in the distillate and how it is distributed, as illustrated in the Examples below. The heavy portion of the distillate is passed through the convection section of a heater, where the temperature is increased to the reaction temperature for hydrocracking. The exact temperature will vary with the space velocity, feedstock and conversion required. It is then passed into the top bed of a downward flow, fixed bed reactor. The top bed contains a hydrocracking catalyst. The catalyst is preferably based on zeolite beta, which may be modified as described supra. It may however, be any catalyst suitable for hydrocracking purposes.

The process may be conducted by contacting the heavier portion of the feedstock with two fixed stationary beds of catalyst in vertical series. A simple configuration is a trickle-bed operation, in which the feed is allowed to trickle through a stationary fixed bed. With such a configuration, it is desirable to initiate the reaction with fresh catalyst at a moderate temperature which is of course raised as the catalyst ages in order to maintain catalytic activity. The catalyst may be regenerated by contact at elevated temperature with hydrogen gas, for example, or by burning in air or other oxygen-containing gas. The recombined feed then passes through a second, stationary fixed bed for dewaxing.

The preliminary hydrocracking step removes sulfur reduces 85% point by cracking larger molecules, and allows dewaxing catalyst to perform at a lower temperature, higher space velocities, lower pressures or combinations of these conditions to be employed in the dewaxing zone while increasing or maintaining distillate yields.

The instant invention functions by cascade operation, cascade operation meaning that all of the material passed over the hydrocracking catalyst is also passed over the dewaxing catalyst. There is no intermediate separation of fluid going from one reaction zone to the next, although the heavy, hydrocracked portion is recombined with the lighter portion of the feed in an inter-bed redistributor, as shown in FIG. 1.

In its simplest form, a cascade operation may be achieved by using a large downflow reactor, wherein the upper portion contains the hydrocracking catalyst and the lower portion contains the dewaxing catalyst.

It may be beneficial to adjust up or down reactor temperature in a second reaction zone, relative to a first reaction zone. Temperature adjustment of the reaction zone is a very good way to accommodate for different relative aging rates of the hydrocracking and dewaxing catalysts, or to accommodate peculiarities of the local installation, where it is desired to adjust the relative amount of reaction occurring in each reaction zone by adjusting the temperature. Overall, an object of the invention is to operate the two reaction zones to reduce the highest temperature of either reaction zone.

The ratio of the catalyst in the hydrocracking zone to the catalyst in the dewaxing zone is normally 1:1. The ratio may vary however, from 0.5:1 to 2:1 depending on the application desired.

If the sulfur is primarily concentrated in the heaviest portion of the feed, then most of the sulfur is removed from the distillate by hydrocracking the heavy portion in the top bed of the reactor. Small amounts of sulfur present in the lighter portions of the feed, as well as sulfur which was not removed from the heavy portion through hydrocracking may be removed by contact with a layer of hydrodesulfurization catalyst placed on top of the dewaxing catalyst in the lower fixed bed. Generally, from about 95 to 99% of the sulfur present in the feed is removed, depending on the product's specification.

Desulfurization catalyst may also be used in the upper portion of the reactor in combination with the hydrocracking catalyst, if it is not possible to remove most of the sulfur of the heavy portion through hydrocracking alone.

The lighter portion of the feed may be passed through the radiation section of a heater, if desired, and heated to an approximate temperature, which when combined with effluent from the hydrocracking zone, would result in the desired reaction temperature in a the dewaxing zone. The desired dewaxing temperature is normally lower than the hydrocracking reaction temperature when the dewaxing catalyst is fresh. The desired dewaxing temperature could be higher than the hydrocracking reaction temperature when the dewaxing catalyst has aged. Therefore, the temperature of the light fraction should be controlled approximately according to the feedstock and the age of the dewaxing catalyst.

The heater may be bypassed altogether, as the diagram illustrates by the presence of the valve. The light distillate portion passes through a heat exchanger prior to its entry into the reactor, as an additional control of the light distillate temperature. The liquid then enters the reactor at the inter-bed redistributor, and mixes with the downflowing effluent of the top bed, as the diagram illustrates. It is also useful as a means of quenching the hydrocracking and accompanying hydrogenation reactions of the top bed. The light and heavy portions of the distillate, now recombined, pass downward over the dewaxing catalyst in the bottom bed.

Process temperatures of about 450°–900° F. (232°–485° C.) may be used conveniently for hydrocracking or dewaxing. Generally, temperatures of about 500°–800° F., (260°–427° C.) preferably about 550°–750° F. (288°–399° C.) will be employed. The hydrogen partial pressure for both hydrocracking and dewaxing is usually in the range of about 200–2000 psia (1380–13,800 kPa), and the lower pressures within this range, about 200–1000 psia (1380–7000 kPa), will normally be preferred. These pressure ranges are critical. The ratio of hydrogen to the hydrocarbon feedstock (hydrogen circulation rate) will normally be from about 250–10,000 (42–1685 $n.m^3/m^3$), preferably about 500–4,000 SCF/bbl (84–675 $n.m^3/m^3$). The space velocity of the feedstock, for either hydrocracking or dewaxing, will normally be from about 0.1–10 $hr^{-1}$ LHSV, preferably about 0.5–2 $hr^{-1}$ LHSV. The product is high in fractions boiling above about 300° F. (150° C.). The pour point of the product is significantly reduced, compared to the pour point of the feedstock.

The dewaxed reactor effluent has a substantially reduced pour point from the distillate feed, as the Examples below indicate. The following examples are used for illustration only and are not intended to be limiting.

EXAMPLES

Example 1—Comparative Example

Table 3 (below) illustrates the advantages of hydrocracking only the heavier portion of a middle distillate feed prior to dewaxing. The characteristics of the whole feed stream versus those of the lighter and heavier feed streams are illustrated, such as pour point and gravity. Yields and properties of products when the whole feed is hydrocracked versus when only the heavy stream is hydrocracked are also illustrated. Cascade operations are often desirable because interstage separation is costly. Interstage separation removes ammonia and $H_2S$, thereby enhancing the activity of the dewaxing catalyst. Catalyst selectivity is not affected by using interstage separation rather than cascade operation. It does not matter if desulfurization catalyst is placed in the top bed or the inlet of the bottom bed. Table 3 illustrates that distillate yield is greater when only the heavier stream is hydrocracked. This is desirable, since distillate is the product in greater demand. Less hydrogen is consumed. Furthermore, less gas, such as $H_2S$, $NH_3$ and $C_1$–$C_4$ (light alkanes), and naphtha are produced as by-products. Hydrocracking of the whole stream prior to dewaxing as well as hydrocracking of only the heavy stream prior to dewaxing provides products which meet diesel product specifications. Hydrocracking of the entire feed provides a lower sulfur content than heavy stream hydrocracking only, but the research octane number of the naphtha by-product is improved by heavy stream hydrocracking only.

TABLE 3

Results of Whole Stream versus Heavy Stream Hydrocracking Only

Feed Source: Statjford Crude

Feed Streams

| | Cut Width | Vol % | Pour Pt, °F. | Gravity, g/cc |
|---|---|---|---|---|
| Whole Feed | 500–800° F. | 100 | 50 | 0.8625 |
| Light Split Stream | 500–650° F. | 55 | 15 | 0.8472 |
| Heavy Split Stream | 650–800° F. | 45 | 80 | 0.8813 |

Diesel Product Specifications

| | |
|---|---|
| Sulfur, wt % | 0.05 |
| Distillation, T85% °F. | 690 |
| Pour Point, °F. | −20 |

Product Yields

| | H2 Consumed [SCF/BBL] | Gas Make [wt %] | Naphtha [wt %] | Distillate [wt %] |
|---|---|---|---|---|
| Whole Feed Hydrocracking | 125 | 7.6 | 12.5 | 79.9 |
| Hydrocracking of heavy Stream Only | 50 | 6.2 | 10.6 | 83.2 |

Product Properties

| | Sulfur [wt %] | Pour Pt [°F.] | T85 [°F.] | Naphtha RON |
|---|---|---|---|---|
| Whole Feed Hydrocracking | <0.01 | −20 | 690 | 85 |
| Hydrocracking of Heavy Stream Only | 0.05 | −20 | 690 | 90 |

Example 2

Figure 2:
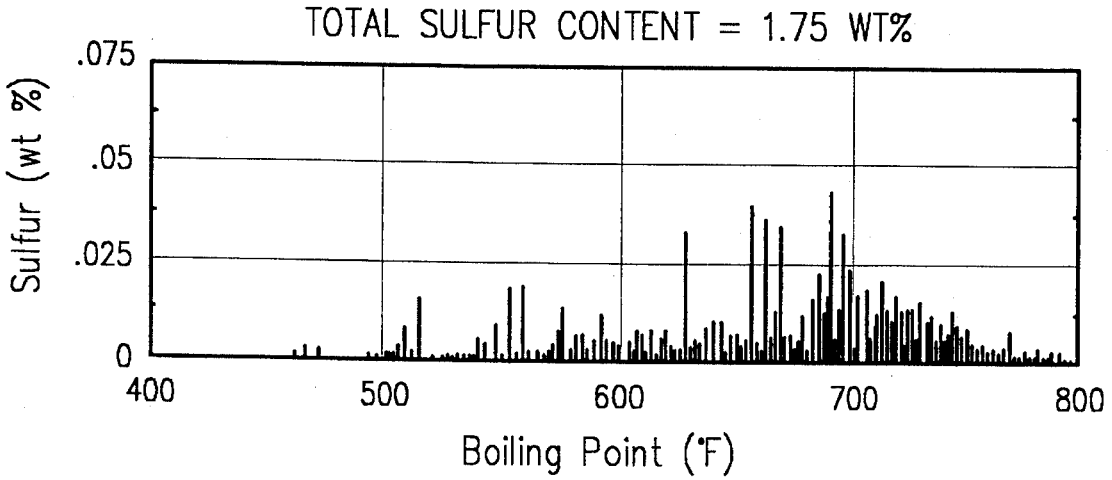
FIG. 2 illustrates the manner in which sulfur compounds are distributed in a feed to a catalytic hydrodesulfurization unit. In this feed, sulfur is concentrated in the portion of the feed which boils at higher temperatures.

FIG. 2 shows a typical sulfur distribution in a feed with a distillate boiling range. Most of the sulfur is concentrated in the heavy fraction. Since hydrocracking would remove almost all the sulfur in the heavy fraction, a proper selection of the feed cutpoint would ensure meeting sulfur specification for the product. For example, the 525° F.—fraction contains 0.04 wt % of the total sulfurs. A 99 wt. % sulfur removal from the heavy fraction, which is not unusual since hydrocracking normally removes almost all the sulfur present, would achieve 0.05 wt % sulfur in the combined light and heavy blend.

Example 3

Figure 3:
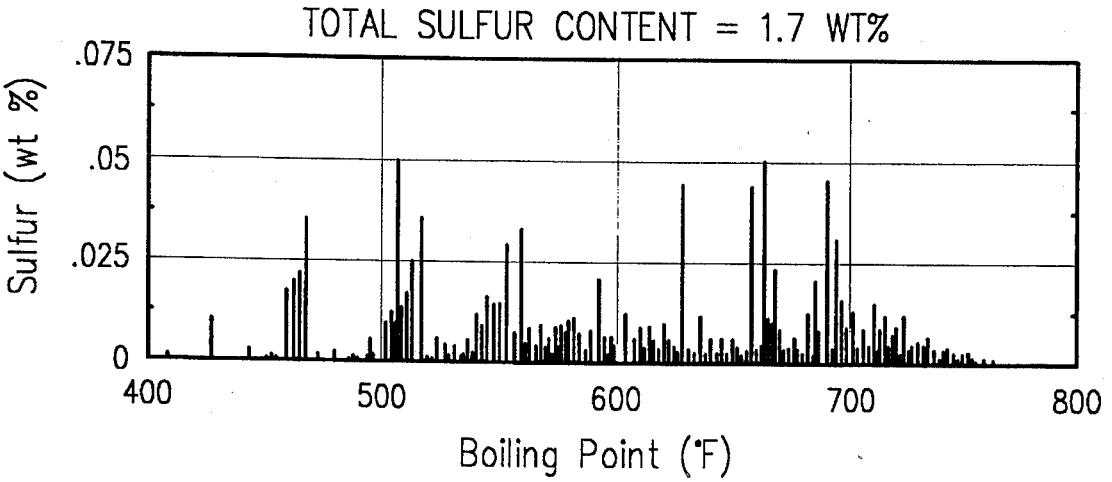
FIG. 3 illustrates another feed to a catalytic hydrodesulfurization unit. Sulfur is evenly distributed throughout the boiling range of this feed.

FIG. 3 depicts a feed with a distillate boiling range in which the sulfur content is evenly distributed throughout the feed. In this case it may not be feasible to meet a stringent sulfur specification by hydrocracking only the heavy fraction in the top bed. Additional desulfurization may be achieved by a layer of desulfurization catalyst on top of the dewaxing catalyst. Desulfurization catalyst can also be added to the top bed to assist the hydrocracking catalyst. It does not matter if the catalyst is added to the top of the top bed or the top of the bottom bed.

What is claimed is:

1. A process of upgrading a waxy hydrocarbon feed mixture containing sulfur compounds, which boils in the distillate range, in order to reduce sulfur content and 85% point while preserving octane of naphtha by-products and increasing distillate yield, wherein the process employs a single, downflow, reactor having at least two catalyst beds, vertically aligned, and an inter-bed redistributor between the beds, the top bed containing a hydrocracking catalyst and a bottom bed containing a dewaxing catalyst, the process comprising the following steps:

(a) separating the hydrocarbon feed mixture into a lighter, lower boiling stream and a heavier, higher boiling stream at a cut point which ranges from 550° to 800° F.;

(b) passing the lighter, lower boiling to the inter-bed redistributor, where it is used as a means of temperature regulation;

(c) hydrocracking the heavier, higher boiling stream in the top bed of the reactor at conditions sufficient to remove at least a portion of the sulfur compounds from the feedstock and effect a boiling range conversion;

(d) passing the effluent of the top bed to the interbed redistributor, where it is mixed with the lighter, lower boiling stream to form a recombined feed stream;

(e) subjecting the recombined feed stream of step (d) to catalytic dewaxing in the bottom bed by contacting the recombined feed stream with a dewaxing catalyst;

(f) recovering a product comprising a distillate having an increased yield and a naphtha having a high research octane number, as compared with a feedstock in which the entire stream was subjected to hydrocracking rather than only the heavier, higher boiling portion.

2. The process of claim 1, wherein the hydrocracking catalyst possesses an acidic function and a hydrogenation/dehydrogenation function.

3. The process of claim 2, wherein the acidic function of the hydrocracking catalyst is provided by zeolite beta.

4. The process of claim 2, wherein the hydrogenation/dehydrogenation component comprises a metal of Group VIIIA of the Periodic Table.

5. The process of claim 4, wherein the hydrogenation/dehydrogenation component comprises from 0.1 to 10 wt % of Pt or Pd on an elemental basis.

6. The process of claim 2, wherein the hydrogenation/dehydrogenation component comprises a Group VIA metal and a Group VIIIA metal in combination.

7. The process of claim 3, wherein the acidic function of the catalyst is provided by zeolite beta.

8. The process of claim 1, wherein the dewaxing catalyst is a medium pore zeolite selected from the group consisting of ZSM-5, ZSM-11,ZSM-12, ZSM-22, ZSM-23, ZSM-35 and ZSM-38.

9. The process of claim 8, wherein the medium pore zeolite is ZSM-5.

10. The process of claim 9, wherein the hydrogenation/dehydrogenation component comprises a noble metal of Group VIIIA of the Periodic Table.

11. The process of claim 9, wherein the hydrogenation/dehydrogenation component comprises metals of nickel, cobalt, molybdenum, tungsten and mixtures thereof.

12. The process of claim 8, wherein the dewaxing catalyst is ZSM-5.

13. The process of claim 1, wherein the lighter, lower boiling stream of step (b) is heated prior to further temperature alteration.

14. The process of claim 1, wherein the ratio of the volume of catalyst in the top bed to the volume of catalyst in the bottom bed is from 0.5:1 to 2:1.

15. The process of claim 1, further comprising contacting the streams with the hydrocracking catalyst, dewaxing catalyst or both catalysts in the presence of hydrogen at temperatures from about 550° F. to 900° F., a hydrogen partial pressure from about 200 to 2000 psia and space velocities-(LHSV) from 0.1 to 10 $hr^{-1}$.

16. The process of claim 1, wherein both the top and bottom beds of the reactor are fixed stationary beds.

17. The process of claim 1, wherein the cut point separating the lighter, lower boiling stream and the heavier, higher boiling stream is in the range from 600° F. to 750° F.

18. The process of claim 1, wherein the cut point separating the lighter lower boiling stream and the heavier, higher boiling stream is in the range from 650°–700° F.

19. The process of claim 1, wherein a layer of desulfurization catalyst is placed on top of the dewaxing catalyst in the bottom bed of the reactor in order to promote further sulfur removal from the feed.

20. The process of claim 1, wherein a layer of desulfurization catalyst is placed below the hydrocracking catalyst in the top bed of the reactor in order to promote further sulfur removal from the feed.

21. The process of claim 1 wherein a layer of desulfurization catalyst is placed in both the top and bottom beds of the reactor in order to promote further sulfur removal from the feed.

* * * * *